US011178943B2

(12) United States Patent
Kaiser et al.

(10) Patent No.: US 11,178,943 B2
(45) Date of Patent: Nov. 23, 2021

(54) METALLIC WATCH STRAP

(71) Applicant: Bucherer AG, Lucerne (CH)

(72) Inventors: Markus Kaiser, Root (CH); Kurt Allemann, Stansstad (CH)

(73) Assignee: BUCHERER AG, Lucerne (CH)

( * ) Notice: Subject to any disclaimer, the term of this patent is extended or adjusted under 35 U.S.C. 154(b) by 0 days.

(21) Appl. No.: 16/779,772

(22) Filed: Feb. 3, 2020

(65) Prior Publication Data

US 2020/0245733 A1 Aug. 6, 2020

(30) Foreign Application Priority Data

Feb. 4, 2019 (CH) ..... 00129/19

(51) Int. Cl.
*A44C 5/24* (2006.01)

(52) U.S. Cl.
CPC ..... *A44C 5/246* (2013.01)

(58) Field of Classification Search
CPC ..... A44C 5/46; A44C 5/24; A44C 5/0092; A44C 5/14; A44C 5/10; A44C 5/2042; Y10T 24/2155; Y10T 24/4782
See application file for complete search history.

(56) References Cited

U.S. PATENT DOCUMENTS 3,349,450 A * 10/1967 Cattin ..... A44B 11/25 24/596.1
3,636,596 A * 1/1972 Iizuka ..... A44B 11/12 24/191
4,288,892 A * 9/1981 Mardirossian ..... A44C 5/2042 24/265 WS
5,134,538 A * 7/1992 Weiss ..... A61N 1/14 361/220
6,311,373 B1 * 11/2001 Hashimoto ..... A44C 5/24 24/265 WS
10,085,528 B2 * 10/2018 Wong ..... A44C 5/22
(Continued)

FOREIGN PATENT DOCUMENTS

CH 710 133 3/2016
EP 2 868 222 5/2015

OTHER PUBLICATIONS

Switzerland Search Report dated Apr. 30, 2019, Application No. 1292019, 2 pages.

*Primary Examiner* — Robert Sandy
*Assistant Examiner* — Rowland Do
(74) *Attorney, Agent, or Firm* — Rankin, Hill & Clark LLP

(57) ABSTRACT

A metallic watch strap, including a first metallic strap half and a second metallic strap half. The first metallic strap half extending along a longitudinal direction and having an upper side and a lower side. The second metallic strap half having a folding clasp with a first fastening structure equipped to be fastened to the first strap half and with a second fastening structure equipped to be fastened to the second strap half. The first fastening structure has a slide, which, in a first state, is displaceable relative to the first strap half in a guided manner, and including a fixation element, which, in a second state, abuts on the first strap half. The first strap half has fixation indentations and the fixation element has at least one fixation projection fitting into the fixation indentations. In the second state, the fixation projection engages into one of the fixation indentations.

16 Claims, 2 Drawing Sheets

(56) References Cited

U.S. PATENT DOCUMENTS

| | | | | |
|---|---|---|---|---|
| 2016/0081439 | A1* | 3/2016 | Catanese | A44C 5/246<br>63/3.1 |
| 2016/0309859 | A1* | 10/2016 | Catanese | A44C 5/246 |
| 2017/0265606 | A1 | 9/2017 | Mace | |
| 2019/0254391 | A1* | 8/2019 | Celant | A44C 5/0053 |
| 2019/0365062 | A1* | 12/2019 | Kelly | A44C 5/2042 |

* cited by examiner

METALLIC WATCH STRAP

BACKGROUND OF THE INVENTION

Field of the Invention

The invention relates to the field of watch straps.

Description of Related Art

Apart from leather straps and plastic straps, in particular metallic straps are also widespread amongst watch straps. On the one hand, metallic watch straps can be present as link watch straps. Concerning these, the strap is formed by metallic links that are articulately connected to one another by pins or the like. On the other hand, straps that are formed by a fine-linked metallic structure, a so-called mesh, are also particularly popular. Such a structure is constructed of several wires that are braided with one another. These are sometimes also known as Milanaise straps and appear particularly noble, especially in combination with a somewhat thinner and/or delicate watch housing design.

For their closure, metallic watch straps with a mesh structure, according to a first option are provided with the traditional buckle tongue-hole solution. This necessitates the metallic braiding being provided with suitably reinforced holes arranged at regular distances. Secondly, there exist clasps with a clamping slide that forms the end of the one strap half and on closure is firmly clamped by a clamping part on the other strap half, wherein the clamping part is pivotable about an axis perpendicularly to the longitudinal direction. Thirdly, so called folding clasps are widespread for metallic link watch straps as well as for metallic watch straps with a mesh structure. These have the advantage that they can be designed in a particularly elegant and robust manner and that they are permanently adjusted to the matching size. However, the latter advantage can also be a disadvantage. Indeed, an adaptation of the watch strap length as a rule is only possible by the watchmaker and only by way of removing/adding a part or by way of exchanging a complete watch strap half. Combinations of clamping slides with a folding clasp also exist. However, they have the disadvantage that a clamping connection with a metallic strap is not always stable over the longer term and can furthermore have the effect of undesirable imprints on the strap.

A closure for a watch strap, in particular for a watch strap of leather, fabric or canvas is taught in CH 710 133. This closure is based on the "Butterfly" principle. A fixation element with a base and a cover is led on one strap half of the strap. The strap half of the strap is provided with a row of central holes (through-holes) in the manner known per se, into which a pin of the base can be inserted, in order to fix the fixation element in its position. If the fixation element is to be displaced, then the cover is lifted by way of a pivoting movement about an axis perpendicular to the longitudinal direction, whereupon the pin can be pushed out of the hole. This solution necessitates through-holes in the strap and would not therefore be suitable for metallic watch straps.

SUMMARY OF THE INVENTION

It is the object of the present invention to provide a metallic watch strap, in particular a mesh watch strap that overcomes the disadvantages of the state of the art and, in particular, permits an elegant, reliable and practical design.

Metallic watch straps have a first strap half and a second strap half that each extend along a longitudinal direction and are with an upper side and a lower side. The strap halves can be flat and essentially tape-like. The lower side is that side, which comes to lie at the inner side, i.e. towards the arm of the user when the watch is worn on the wrist, whereas the upper side is visible inasmuch as it is not covered by the other strap half or something else. Watch straps of the type according to the invention furthermore include a folding clasp. Such a folding clasp includes a plurality of segments that are connected to one another via pivot joints (hinges) and can generally be latched in a closed (folded-together) state. The two segments that form the outer ends in an open state are each provided with a fastening structure for fastening to the first and second strap half respectively. The fastening can be effected via a permanent or a releasable connection.

For achieving the object of the invention, it is suggested to design the first fastening structure in a displaceable manner relative to the first strap half by way of it including a slide, which in a first state, is displaceable relative to the first strap half in a guided manner. The first fastening structure includes a fixation element, for example a clamping element, such as an elongate clamping element. This fixation element includes at least one fixation projection, and fixation indentations that match these are arranged in a row, for example at regular distances, on the lower side of the first strap half. In the second state of the first fastening structure, the fixation projection engages into one of the fixation indentations—depending on the position of the first fastening structure.

The fixation indentations are indentations in the respective strap half of the watch strap, i.e. blind holes, which are generally relatively shallow, so that they are designed as wells or recesses. The incorporation of indentations in the context of well-like indentations on metallic watch straps is possible, e.g., by way of an embossing (stamping-in, impressing) procedure and, in contrast, for example, to through-holes, this is possible without any large compromises with regard to complications in the manufacturing process or to aesthetic aspects.

The fixation element can be an element, which, in the second (closed) state, runs transversely to the longitudinal direction of the first strap half along its lower side and which is fastened to the slide of the first fastening structure via a joint with a joint axis, which runs parallel to the longitudinal axis. The element can especially be an elongate clamping element. The elongate clamping element can be latched in, for example, at the side that lies opposite the joint—similarly to the principle of elongate clamping elements as are known for metallic dressage watch straps.

Such an arrangement with an element that lies transversely to the longitudinal direction is particularly advantageous. On the one hand, it permits the manufacture of the element, especially elongate element, and possibly of a latching mechanism for its fixation in the second (closed) state, with particularly delicate structures, which is a huge advantage in the case of watch straps. On the other hand, one prevents the fixation element from being able to open on its own accord given an occurring tensile loading as normally occurs on wearing the watch. Tensile forces on the watch strap act transversely to the joint axis (pivot), on which the fixation element is mounted and for this reason do not load the mechanism, with which the fixation element is held in the closed state (for example latching mechanism).

The attachment of the fixation element to the lower side of the strap is also advantageous in respect to this, firstly due to the fact that the fixation element is not accessible when the watch is worn and secondly the fact that the bearing of the strap on the arm contributes to preventing an unintended release of the fixation.

On account of the principle of the at least one fixation projection, which interacts with fixation indentations, one succeeds in the position of the first fastening structure relative to the first strap half being fixed by way of a positive fit. On account of this, the advantages of a positive-fit connection as are known from the buckle tongue-hole solution result. These advantages include an exactly defined position that cannot be displaced even after a long-term loading (long-term stability), paired with a material preservation—in contrast, for example, to clamping connections (friction-fit connections) on leather straps or metallic straps, the connections effecting irreversible imprints on the strap. Despite this, the procedure according to the invention maintains the advantages of folding clasps, in particular the more simple and elegant handling compared to a buckle tongue-hole solution.

A further advantage is the fact that a possible synergy can be utilised by way of the combination of the first fastening structure which is designed as aforementioned, with a folding clasp. The folding clasp can be designed such that at least one of its segments covers the first fastening structure including the fixation device towards the lower side, i.e., towards the arm of the wearer. In contrast to the solutions with only a clamp, the arcuate folding clasp, which generally follows the anatomical conditions, can prevent the fixation element from irritating the wearer.

The strap halves of the watch strap in particular are manufactured from a metal mesh (metal braiding), i.e., the present invention is particularly suitable for such mesh straps (the word "braiding" is to signify the fact that the metal structures engage into one another whilst forming a network and does not assume anything about a manufacturing method) or for "Milanaise" straps.

In particular, the strap halves of the watch strap can be manufactured from stainless steel. Other materials, for example precious metals are also considered.

The folding clasp includes at least two segments that are each fastened at the end to the first and second fastening structure respectively by way of a joint and are connected to one another via a further joint. In the context of the procedure according to the invention, so-called "butterfly" folding clasps, which include three segments and in total four joints (hinges), are particularly suitable.

The fixation indentations form at least one row of, for example, at least four fixation indentations. In particular, the fixation indentations of each row have the same lateral position (position transverse to the longitudinal direction) and are arranged, for example, at regular distances. The row(s) can be made almost arbitrarily long in accordance with the requirements. For this reason, the concept according to the invention permits a longitudinal adjustability over a large range without the watch strap having to be shortened.

In particular, the fixation indentations can form two rows, wherein then accordingly two fixation projections can be present. The fixation projections can be arranged next to one another at axial positions (positions along the longitudinal direction) that correspond to one another. More than two rows/projections, i.e., three, are also possible.

The fixation indentations can be formed by way of embossments (indentations, stamping-in) on the first strap half. They can optionally be metallically lined, which however is not technically necessary.

As is known per se, the second fastening structure can be fixedly connected to the second strap half, for example at the end.

In addition to the two strap halves and the folding clasp with the two fastening structure, the watch strap can include a loop, which is applied around the second strap half, receives the piece of the first strap half, which projects beyond the fastening structure, and can be applied onto the second strap half—as is also known from leather or plastic straps. In particular, such a loop can include a spring, in order to slightly clamp the strap half or strap halves that are led in it. Such a spring provides the loop with an improved positional stability.

BRIEF DESCRIPTION OF THE DRAWINGS

The subsequent drawings represent exemplary embodiments of the invention, by way of which the invention is described in detail. In the drawings, the same reference numerals denote the same or analogous elements. The drawings show.

DETAILED DESCRIPTION OF THE INVENTION

Figure 1:
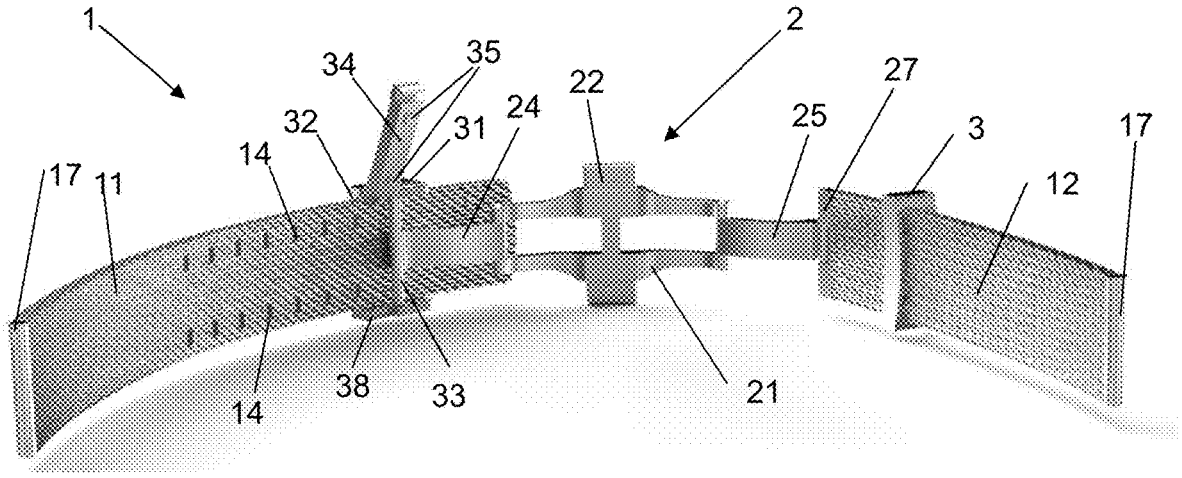
FIG. 1 a view of a watch strap in the opened state with the opened first fastening structure.

The watch strap 1 according to FIGS. 1-5 includes a first strap half 11 from a metallic braiding, a second strap half 12 from the same metallic braiding, a butterfly clasp 2 and a loop 3.

The first strap half includes two rows of seven fixation indentations 14, which are designed as rectangular embossments. At the end—i.e. towards the watch casing (not shown)—a watch casing fastening 17 is fixedly attached to both strap halves 11, 12.

The butterfly folding clasp 2 as is known per se includes a middle segment 21 as well as two outer segments 24, 25 that are connected to one another via joints. At the end side, the outer segments 24, 25 are each connected to a first fastening structure 31 and a second fastening structure 27 respectively, in each case via a further joint. The segments are arcuate such that they are adapted to the anatomy of the human arm. The second fastening structure 27 is fixedly attached to an end (lying opposite the watch casing fastening 17) of the second strap half. The first fastening structure 31 is assigned to the first strap half and is fastenable to this, so that the folding clasp connects the first and the second strap half.

Figure 2:
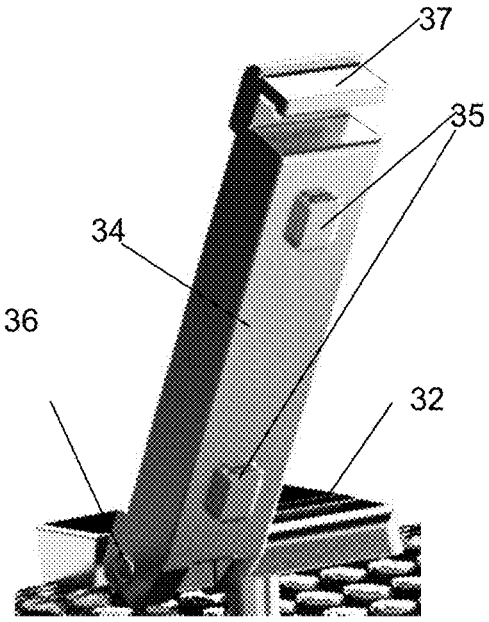
FIG. 2 a detail of FIG. 1 with the clamp of the first fastening structure.
Figure 3:
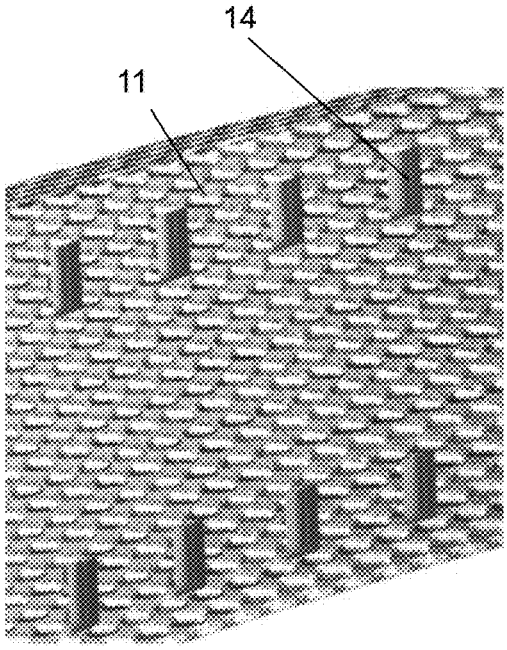
FIG. 3 a detail of FIG. 1 with the first strap half and with two rows of fixation indentations as well as with four visible fixation indentation positions.
Figure 4:
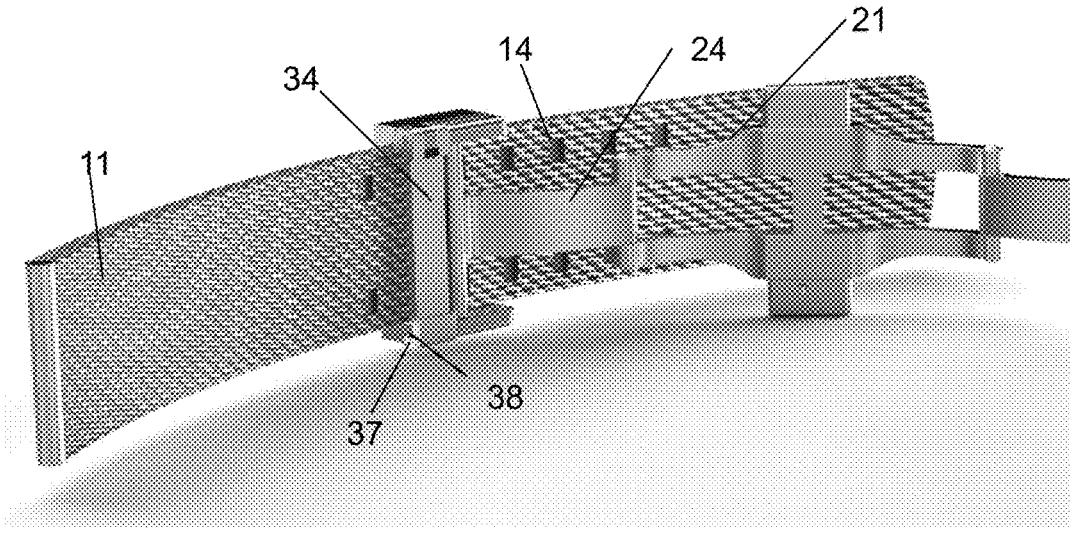
FIG. 4 a view of the watch strap of FIG. 1 in the opened state but with a closed first fastening structure.

The first fastening structure 31 includes a slide 32, on which a pin 33 of the respective outer segment 24 is rotatably fastened about its axis for forming a joint. Furthermore, the first fastening structure includes a fixation element 34, which can be an elongate clamping element 34. Two fixation projections 35 are formed on this, and the rectangular shape and size of these are matched to the shape and the size of the fixation indentations 14. The elongate clamping element is pivotable transversely to the longitudinal direction of the first strap half on a pivot joint, which is formed by a clamping element pin 36, and can be brought from the open state, which is shown in FIGS. 1 and 2, into a closed state (FIG. 4) by way of a corresponding pivoting movement, wherein the position of the slide relative to the first strap half is to be selected such that the elongate clamping element is aligned onto a pair of indentation openings 14. In the closed state, the elongate clamping element extends transversely over the first strap half 11 and the first strap half is clamped between the elongate clamping element and the slide. The fixation projections 35 engage into fixation indentations 14 and thus effect a positive fit with regard to displacements of the slide in the longitudinal direction of the strap half.

In the closed state, a latching structure 37 of the elongate clamping element engages into a corresponding latching structure 38 of the slide at the side that lies opposite the clamping element pin 36 and hence fixes the elongate clamping element in the closed state. The elongate clamping element is furthermore covered to the arm of the wearer of the watch by the segments of the folding clasp (FIG. 5) when this is closed. By way of this, an unintended opening of the first fastening structure is additionally prevented.

If the length of the watch strap is to be adjusted, the wearer must remove the watch from the wrist and open the elongate clamping element 34 in the opened state of the folding clasp, displace the slide by one or more positions in the rows of fixation indentations 14 and close the elongate clamping element again.

Figure 5:
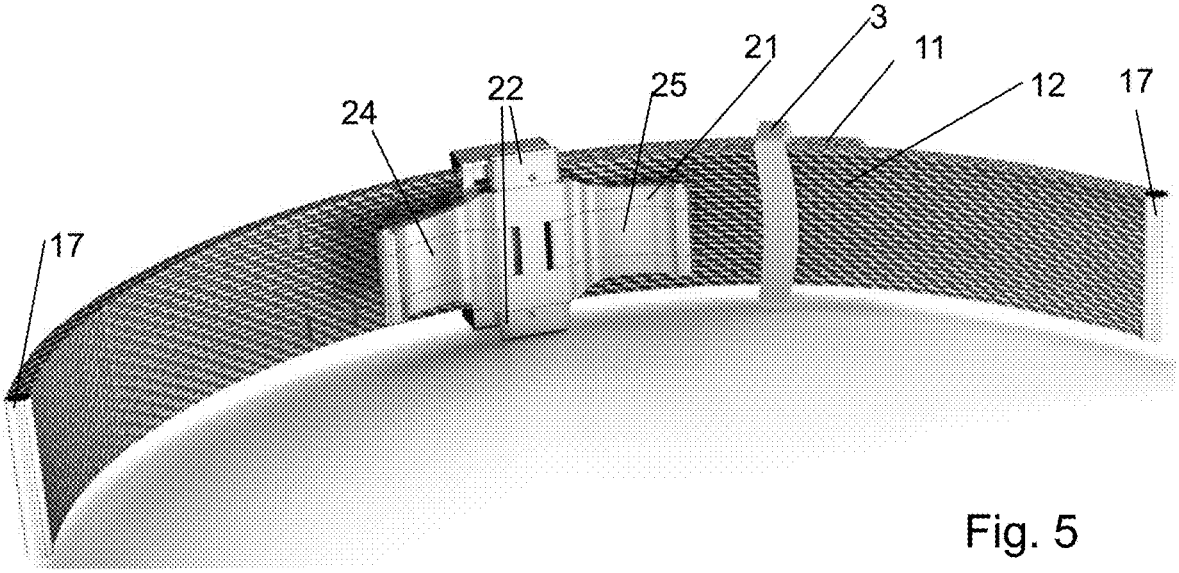
FIG. 5 the watch strap in the closed state.

As is known per se, the folding clasp 2 includes a latching mechanism, by way of which it can be latched in its closed state, which is shown in FIG. 5. In this state, the outer segments 24, 25 are located between the two webs that form the middle segment 21, so that the arrangement is less bulky as possible, as can be seen in FIG. 5. For opening the watch strap, two lock push buttons at the outer side are to be actuated simultaneously, in order to release the latching mechanism.

The loop 3 is applied around the second strap half 12 and serves for guiding the piece of the first strap half 11 which projects beyond the first fastening structure, said piece hence being able to bear on the second strap half 12 in a manner in which is better fixed. The loop can likewise be metallic. In order to avoid an undesirable, too resistance-free sliding of the loop 3 on the first strap half 12 or on both strap halves 11, the loop at the inner side is includes, for example, a small spring, for example a leaf sprung which is bent inwards, by way of which the strap half or the strap halves is/are slightly clamped in the inside of the loop.

The invention claimed is:

1. A metallic watch strap, comprising:

a first metallic strap half, the first metallic strap half extending along a longitudinal direction and having an upper side and a lower side;

a second metallic strap half; and a folding clasp with a first fastening structure equipped to be fastened to the first strap half and with a second fastening structure equipped to be fastened to the second strap half;

wherein the first fastening structure comprises a slide which in a first state is displaceable relative to the first strap half in a guided manner;

wherein the slide comprises a fixation element which in a second state abuts on the first strap half;

wherein the first strap half comprises at least one row of at least two fixation indentations, said row extending along the longitudinal direction;

wherein the fixation element comprises at least one fixation projection fitting into the fixation indentations;

wherein in the second state the fixation projection engages into one of the fixation indentations, whereby the first fastening structure is fixedly fastened to the first strap half in the second state;

wherein the fixation element is held relative to the slide on a pivot joint whose joint axis runs parallel to the longitudinal direction, so that the fixation element lies transversely to the longitudinal direction in the second state; and wherein the fixation element comprises a latching structure at a side which lies opposite the joint, said latching structure latching with a corresponding latching structure of the slide in the second state.

2. The watch strap according to claim 1, wherein the fixation indentations are present on the lower side of the first strap half; and wherein in the second state the fixation element abuts on the lower side of the first strap half.

3. The watch strap according to claim 2, wherein the fixation element is held relative to the slide on a pivot joint whose joint axis runs parallel to the longitudinal direction, so that the fixation element lies transversely to the longitudinal direction in the second state.

4. The watch strap according to claim 3, wherein the fixation element comprises a latching structure at a side which lies opposite the joint, said latching structure latching with a corresponding latching structure of the slide in the second state.

5. The watch strap according to claim 3, wherein the fixation element is an elongate clamping element.

6. The watch strap according to claim 1, wherein the fixation element is an elongate clamping element.

7. The watch strap according to claim 1, wherein the first strap half and the second strap half each comprise a metallic mesh structure.

8. The watch strap according to claim 1, wherein the fixation indentations form two rows which lie next to one another and wherein the fixation element comprises one fixation projection per row.

9. The watch strap according to claim 1, wherein the first strap half comprises at least four indentations per row so that the first fastening structure is fastenable relative to the first strap half at correspondingly at least four different positions.

10. The watch strap according to claim 1, wherein the fixation indentations are embossments in the first strap half.

11. The watch strap according to claim 1, wherein the fixation indentations and the at least one fixation projection each have a rectangular outline.

12. The watch strap according to claim 1, further comprising a loop around the second strap half, said loop being provided with a spring, and said loop being shaped for receiving a piece of the first strap half which projects over the first fastening structure.

13. The watch strap according to claim 1, wherein the folding clasp is a butterfly folding clasp with three segments which are pivotable to one another in pairs and which form a row.

14. The watch strap according to claim 13, wherein two outer segments in a closed state lie between two webs of a middle segment or the middle segment in the closed state lies between two webs of the two outer segments.

15. The watch strap according to claim 1, wherein at least one segment of the folding clasp covers the fixation element towards the lower side in a closed state of the folding clasp.

16. The watch strap according to claim 1, wherein the second fastening structure is fixedly connected to one end of the second strap half.

* * * * *